US005181299A

United States Patent [19]

Huang

[11] Patent Number: 5,181,299

[45] Date of Patent: Jan. 26, 1993

[54] ZIPPER HAVING ANTI-JAM FLAPS

[76] Inventor: Hung C. Huang, 4340 E. Florence Ave., Bell, Calif. 90201

[21] Appl. No.: 804,378

[22] Filed: Dec. 10, 1991

[51] Int. Cl.[5] ..... A44B 19/00

[52] U.S. Cl. ..... 24/432; 24/381; 24/426

[58] Field of Search ..... 24/432, 381, 384, 393, 24/426, 427, 428, 429

[56] References Cited

U.S. PATENT DOCUMENTS

| | | | |
|---|---|---|---|
| 2,061,681 | 11/1936 | Norton | 24/432 |
| 2,084,499 | 6/1937 | Newman | 24/432 |
| 2,176,229 | 10/1939 | Siegel | 24/432 |
| 2,218,089 | 10/1940 | Marinsky | 24/432 |
| 2,866,245 | 12/1958 | Elgin | 24/426 |
| 3,561,073 | 2/1971 | Rosser | 24/432 |
| 3,685,103 | 8/1972 | Severino | 24/381 |

FOREIGN PATENT DOCUMENTS

| | | | |
|---|---|---|---|
| 1068380 | 6/1954 | France | 24/432 |
| 1402623 | 5/1965 | France | 24/432 |

*Primary Examiner*—Victor N. Sakran
*Attorney, Agent, or Firm*—Sughrue, Mion, Zinn, Macpeak & Seas

[57] ABSTRACT

A zipper including a pair of rows of teeth, a catch for joining/unjoining the two rows of teeth as the catch is moved relative to the two rows of teeth; a pair of flaps disposed underneath the two rows of teeth, respectively, such that as the catch moves relative to the two rows of teeth to join the two rows of teeth together, the pair of flaps overlap each other, thereby preventing extraneous material from being entangled in the catch and the two rows of teeth.

5 Claims, 1 Drawing Sheet

ZIPPER HAVING ANTI-JAM FLAPS

FIELD OF THE INVENTION

The present invention relates to a zipper and, more particularly, to a zipper which includes anti-jam flaps for preventing extraneous material from becoming entangled in the zipper.

BACKGROUND OF THE INVENTION

A conventional zipper consists of two rows of teeth and a slide or catch that joins or separates the two rows of teeth. Conventional zippers frequently jam when fastening or unfastening. Jamming occurs when extraneous material is drawn into and becomes entangled with the teeth of the zipper as the slide moves past the two rows of teeth. This is particularly troublesome for very soft material or material that hangs loosely around the slide.

SUMMARY OF THE INVENTION

It is therefore an object of the invention to provide an improved zipper which does not become entangled with extraneous material.

It is another object of the invention to provide an improved zipper which does not become entangled with extraneous material and which is easy and inexpensive to manufacture.

It is another object of the invention to provide an improved zipper which can be used with garments and the like, and which serves to prevent wind from blowing through the teeth of the zipper.

It is another object of the invention to provide an improved zipper which can be used with garments and the like, and which serves to protect the skin of the garment's wearer from the metal teeth of the zipper.

These and other objects of the invention are accomplished by the present invention which provides a zipper having overlapping flaps between the teeth of the zipper and the material to which the zipper is attached.

DESCRIPTION OF A PREFERRED EMBODIMENT

Figure 1:
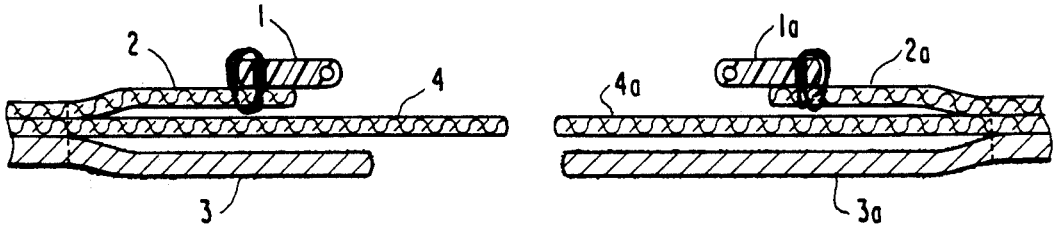
FIG. 1 is a cross sectional view of the zipper according to the invention showing the teeth and backing flaps before the slide has connected the two halves of the zipper.

FIG. 1 shows the zipper according to the present invention in an open position. As shown in FIG. 1, the zipper of the present invention includes two rows of teeth 1 and 1*a*, which are attached, e.g., sewn to respective material pieces 2, and 2*a*, which in turn are attached, e.g., sewn, to the material 3, 3*a* of the particular garment or item containing the zipper. The two rows of teeth 1, 1*a* and material pieces 2, 2*a* represent the conventional zipper. According to the invention, two flaps of material 4, 4*a* are attached by sewing the flaps separately or together, by gluing or the like such that the two flaps 4, 4*a* are disposed underneath the two rows of teeth 1, 1*a*, as shown in FIG. 1. Specifically, the flaps 4, 4*a* are disposed between the two rows of teeth 1, 1*a* and the material or item 3, 3*a* to which the teeth are attached.

Figure 2:
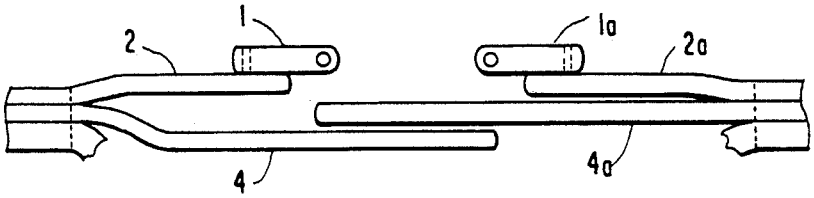
FIG. 2 is a cross sectional view showing the zipper teeth and backing flaps as the teeth are joining.
Figure 3:
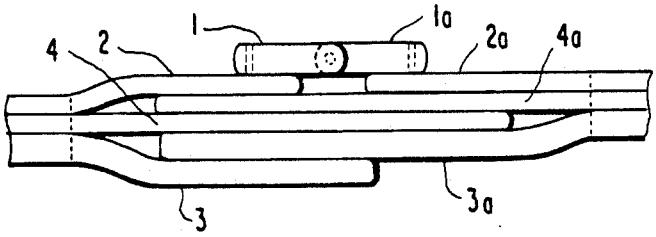
FIG. 3 is a cross sectional view showing the zipper teeth and flap configuration when the zipper is completely joined or closed.

The flaps 4, 4*a* prevent the zipper from jamming both when joining and separating the teeth 1, 1*a*. FIG. 2 shows the zipper of the invention during the closing state, and FIG. 3 shows the zipper in the fully closed state. When the zipper is closed, that is, when the two rows of teeth 1, 1*a* have been joined together, the two flaps 4, 4*a* overlap, as shown in FIG. 3. Thus, the zipper teeth 1, 1*a* are separated from the underlying material 3, 3*a* by the overlapping flaps 4, 4*a*.

The flaps 4, 4*a* are configured such that they cannot become entangled in the zipper as the slide 5 (FIG. 4) disengages the teeth 1, 1*a*. The underlying material 3, 3*a* that is fastened by the zipper also cannot become entangled when the slide 5 disengages the teeth 1, 1*a* because the overlapping flaps 4, 4*a* prevent any contact between the zipper teeth and the underlying material while the teeth are being disengaged.

Figure 4:
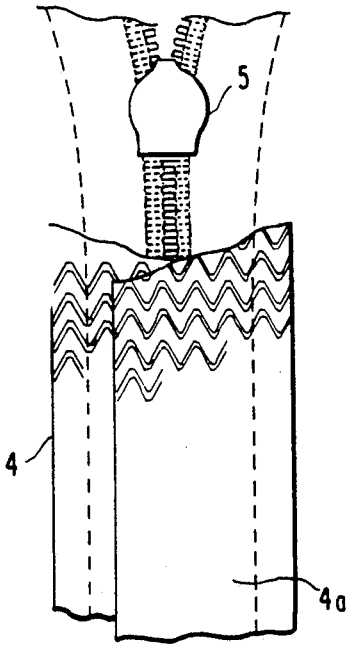
FIG. 4 is a back partially-cut away view showing a joined section of zipper with the backing flaps cut away at the top to demonstrate the relationship of the zipper and each backing flap.

FIGS. 3 and 4 illustrate how the flaps 4, 4*a* isolate the zipper teeth 1, 1*a* from the underlying material.

Figure 5:
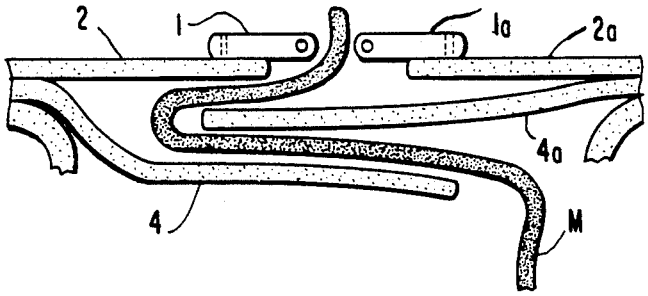
FIG. 5 is a cross sectional view showing how extraneous material must snake around the two flaps of the invention in order to become entangled in the zipper teeth.

The flaps 4, 4*a* also help to prevent any material from becoming entangled in the zipper teeth when the slide joins the rows of teeth. The flaps are configured such that they will not catch in the teeth as the slide joins the teeth. As the slide joins the teeth, the flaps are pulled together as shown in FIGS. 1, 2 and 3. In order for any extraneous material M to become entangled in the teeth, such material would have to snake around the flaps 4, 4*a* and then back into the teeth, as shown in FIG. 5. Such a snaking configuration is highly unlikely to occur. The presence of the flaps thus greatly reduces the likelihood that extraneous material will become entangled in the teeth while the teeth are being joined.

Also, the flaps serve to push the extraneous material away from the teeth when the teeth are being joined. As the teeth are joined, the flaps are drawn together causing the flaps to push away any material therebetween. Accordingly, this pushing action serves to prevent extraneous material from jamming the zipper. This pushing action and attendant advantages can be enhanced by stiffening the flaps 4, 4*a*. Specifically, the edges of the flaps may be coated with a nylon or plastic solution in order to provide adequate stiffness for pushing material away from the zipper teeth, without sacrificing the flexibility of the entire zipper assembly.

The improved zipper according to the invention is especially useful for products having uneven surfaces, such as sleeping bags and certain types of luggage. Further, the improved zipper can be used with winter coats, garments and the like in which it is desirable to reduce the effects of wind directly blowing through the teeth of the zipper. In addition, the zipper of the invention can used with garments and the like in which the skin of the garment wearer's body is sensitive to the metal teeth of the zipper. In this regard, the flaps of the inventive zipper serve to prevent wind from blowing through the zipper's teeth, and also serve as a protective boundary between the metal teeth of the zipper and the user's skin.

While I have illustrated and described a preferred embodiment, those skilled in the art will understand that various changes and modifications may be made without departing from the spirit of the invention.

What I claim is:

1. A zipper of the type including two rows of teeth, and a catch for joining/unjoining the two rows of teeth as the catch is moved relative to the two rows of teeth, the improvement comprising:

a pair of flaps disposed underneath said two rows of teeth, respectively, said flaps being attached to the zipper such that as the catch moves relative to the two rows of teeth to join the two rows of teeth together, said pair of flaps overlap each other, each of said pair of flaps having a width which extends beyond a width of said two rows of teeth such that when said pair of flaps overlap each other, each of said flaps covers and extends beyond a center of said two rows of teeth thereby preventing extraneous material from being entangled in the catch and the two rows of teeth.

2. The zipper as defined in claim 1, wherein an edge of each of said flaps is coated with a plastic solution.

3. The zipper as defined in claim 1, wherein an edge of each of said flaps is coated with nylon.

4. A zipper as defined in claim 1, further comprising an article, wherein said two rows of teeth are attached to the article through seams, respectively, and wherein each of said flaps has a width such that when said flaps overlap each other, each of said flaps extends approximately to a different one of said seams.

5. The zipper as defined in claim 1, wherein said zipper includes only a single said pair of flaps.

* * * * *